US005366309A

United States Patent [19]

Springall

[11] Patent Number: 5,366,309

[45] Date of Patent: Nov. 22, 1994

[54] APPARATUS FOR APPLYING ADHESIVE

[76] Inventor: Ernest G. L. Springall, P.O. Box 1192, Kitchener, Ontario, Canada, N2G 4G8

[21] Appl. No.: 87,299

[22] Filed: Jul. 8, 1993

[51] Int. Cl.[5] ..... B65D 83/60

[52] U.S. Cl. ..... 401/48; 401/137; 222/608; 222/399; 118/108; 118/305

[58] Field of Search ..... 401/48, 140, 190, 137–139; 118/108, 305, 207; 222/608, 399; 239/140, 147, 150, 151, 170

[56] References Cited

U.S. PATENT DOCUMENTS

| | | | |
|---|---|---|---|
| 1,783,689 | 12/1930 | Angier | 222/399 X |
| 2,808,080 | 10/1957 | Dion-Biro | 222/399 X |
| 2,832,425 | 4/1958 | Jacobs | 222/399 X |
| 4,124,315 | 11/1978 | Melton | 401/48 |
| 4,471,713 | 9/1984 | Cote et al. | 401/48 X |
| 4,893,751 | 1/1990 | Armstrong | 118/305 X |
| 5,254,167 | 10/1993 | Janoski et al. | 401/48 X |

*Primary Examiner*—Danton D. DeMille

*Attorney, Agent, or Firm*—Arne I. Fors; Jeffrey T. Imai

[57] ABSTRACT

An apparatus for administering an adhesive for attaching carpet to undercushion and ceramic tiles and other flooring to a substrate. The apparatus includes a reservoir for holding the adhesive, support rails, a pressure tank, a conduit for conducting a gas from the pressure tank to the reservoir, a pressure regulator in series with the conduit and an applicator head for dispensing the adhesive to the substrate. The applicator head may be pivoted into an inoperative position for preventing discharge of adhesive therefrom.

4 Claims, 2 Drawing Sheets

APPARATUS FOR APPLYING ADHESIVE

FIELD OF THE INVENTION

This invention relates to an adhesive applicator and, more particularly, relates to an adhesive applicator of the type wherein a liquid adhesive under pressure is administered to a substrate.

BACKGROUND OF THE INVENTION

The application of adhesives to floor substrates, for example for the purpose of laying carpet to undercushion, ceramic tiles, linoleum and vinyl tile normally necessitates manual application of an adhesive by a person kneeling on his or her knees. Prolonged kneeling and bending, especially by tradespeople over many years, results in knee and back problems and disabilities.

Applicators are known for applying adhesives to a floor substrate. U.S. Pat. No. 4,798,163, for example, discloses the use of a device for applying a liquid adhesive, in particular hot melt adhesive. The device comprises a reservoir, a separate application nozzle, and a shutoff valve in a line from the reservoir to the nozzle. This patent particularly relates to an improved nozzle for administering hot melt adhesive. The apparatus contains a melting means for the hot melt adhesive to reduce the pressure required to pump the hot melt adhesive through the nozzle to the substrate.

U.S. Pat. No. 4,919,072 discloses an apparatus for applying a hot melt adhesive to a substrate. The apparatus includes a heating means for heating the hot melt adhesive and an electrical control means for regulating the heating means. An application head applies the hot melt adhesive to the substrate either as a thin uniform layer or as a spray. The electrical control means is detachable from the apparatus.

SUMMARY OF THE INVENTION

The above two patents are directed to specific components of a spreader for applying hot melt adhesive. The apparatus of the present invention relates to an improved adhesive applicator for applying a liquid adhesive, usually a water-based adhesive, under pressure as beads to a floor substrate.

In its broad aspect, the apparatus for applying an adhesive to a substrate comprises a reservoir for holding the adhesive, said reservoir having a bottom wall inclined to the horizontal, a pair of spaced apart parallel support rails extending upwardly from said bottom wall, a pair of side walls secured to the support rails forming a base, a set of wheels depending from the base for portability, a pair of spaced apart cross members secured to the support rails, a pressure tank for receiving a gas removably attached to said cross members, a conduit for conducting a gas from the pressure tank to the reservoir, a pressure regulator in series with said conduit, said pressure regulator having control means for regulating the pressure of gas supply to said reservoir; an applicator head for dispensing the adhesive to the substrate, said applicator head comprising means for pivotally mounting said applicator head on said reservoir in proximity to the base thereof whereby said applicator head can be pivoted into an operative adhesive dispensing position or pivoted into an inoperative position for preventing discharge of adhesive therefrom.

BRIEF DESCRIPTION OF THE DRAWINGS

The present invention will now be described with reference to the accompanying drawings, in which.

DETAILED DESCRIPTION OF THE PREFERRED EMBODIMENT

Figure 1:
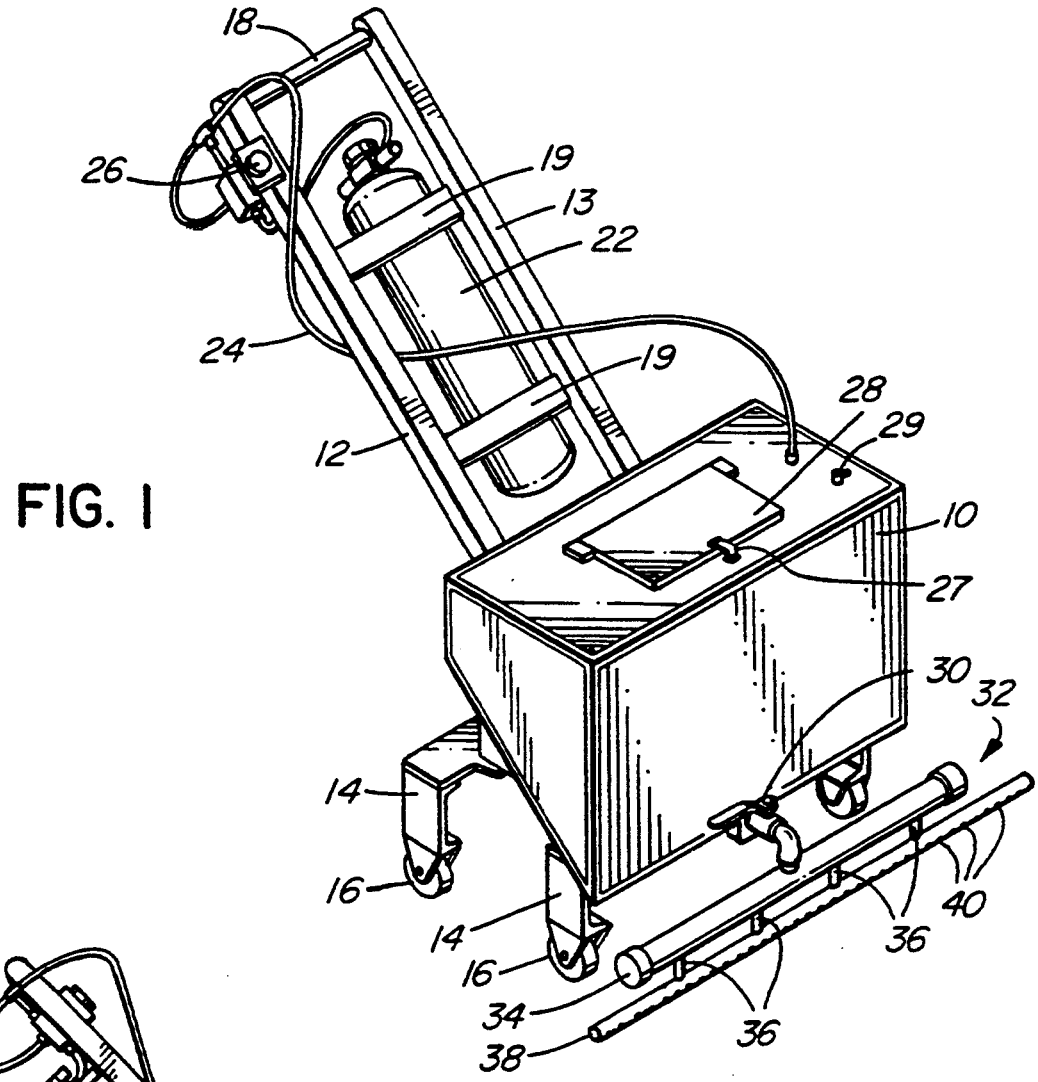
FIG. 1 is a perspective view of the apparatus of the invention in an operative position.
Figure 4:
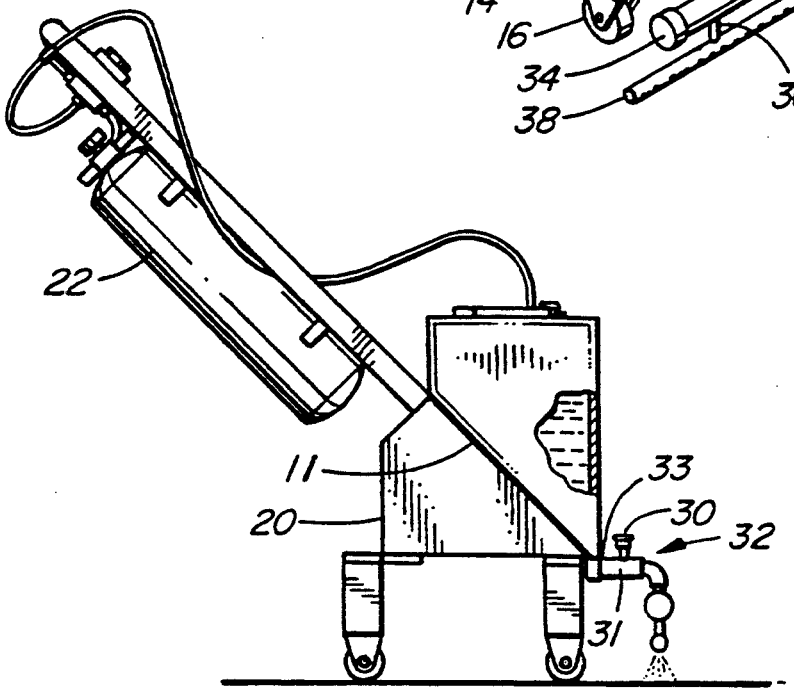
FIG. 4 is a side elevation of the apparatus of the invention, partially cut away, showing the adhesive contained within the reservoir.
Figure 2:
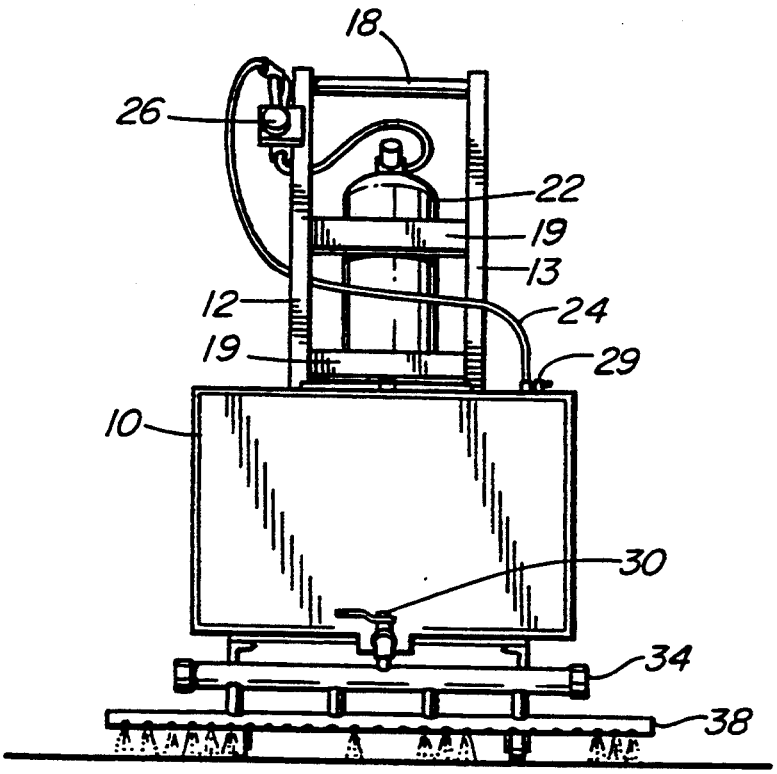
FIG. 2 is a front elevation of the said apparatus.

Referring to FIGS. 1 and 2, the adhesive applicator comprises a reservoir 10 of generally trapezoidal shape for holding an adhesive. The bottom wall 11 of the reservoir 10 projects downwardly to allow the adhesive to be effectively drained to the bottom of the reservoir and to receive longitudinal support rails 12, 13 which extend upwardly therefrom for reasons which will become apparent as the description proceeds. Side walls 20, one of which is shown, are secured to support rails 12, 13, to form a rigid base for supporting reservoir 10 and for mounting supports 14 having casters 16 to allow for transport of the adhesive applicator. Side walls 20 also function as reinforcing plates to stabilize reservoir 10 on supports 14.

Rails 12, 13 project upwardly from reservoir 10 and terminate with handle 18 extending there between. Gas reservoir tank 22 is secured to cross members 19 which in turn are fastened to rails 12, 13. Tank 22 is secured in a quick disconnect manner well known in the art.

In the preferred embodiment, air is the gas contained within gas reservoir tank 22 and the quick disconnect attachment allows gas reservoir tank 22 to be removed to allow for filling at an air supply depot. Many gas stations have an air pressure supply, thus providing easy access for filling said gas reservoir tank 22 and for decreasing the amount of time the adhesive applicator is not in use.

Gas pressure controller 26 in series in gas line 24 ensures a uniform desired operating pressure is maintained in reservoir tank 10.

Reservoir tank 10 contains an opening on its top surface to allow for the liquid adhesive to be placed within it. Closure lid 28 having locking clamp 27 effects an air tight seal in the reservoir 10.

Initially, reservoir 10 is filled approximately three-quarters full with liquid adhesive, said adhesive preferably having a viscosity in the range of about 11,000–13,500 centipoise. This allows for a pressurized volume of gas to be pumped into the top section of reservoir 10. Since reservoir 10 is pressurized, it is desirable to have a pressure relief valve 29 which will prevent dangerous pressure build-up.

Control lever 30 in discharge line 31 at the bottom of reservoir 10 opens and closes a flow valve 31 allowing the adhesive to travel from reservoir 10 to applicator head 32. Applicator head 32 includes a manifold 34 and a plurality of equispaced inter-connecting pipes 36 to connect manifold 34 to dispenser 38. Dispenser 38 has a plurality of holes 40 formed at substantially equally spaced intervals for dispensing the adhesive to a substrate. Dispenser 38 is supported approximately 1 to 2 inches above the substrate to allow for beading of the adhesive on the substrate. This beading allows for effective application of the adhesive to the substrate and allows for placement of material on the substrate with less spillage.

Figure 3:
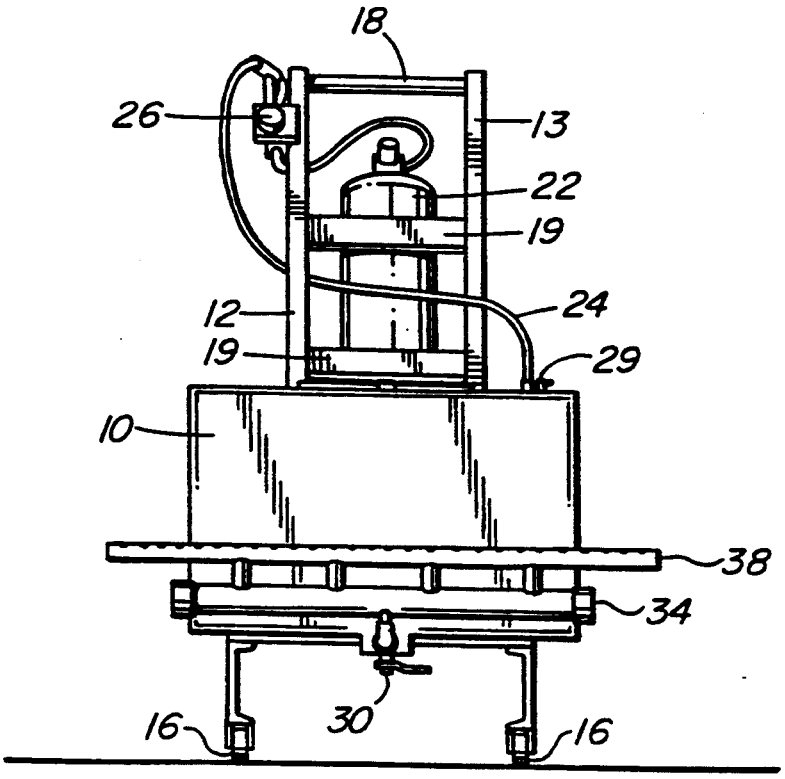
FIG. 3 is a front elevation of the said apparatus showing the delivery means in an inverted inoperative position.

Applicator head 32 has a swivel connection 33 attaching it to reservoir 10 allowing for inversion of application head 32, as shown in FIG. 3, to prevent leakage when not in use. After use, a solvent such as water is placed in the reservoir to prevent hardening of any leftover adhesive.

The adhesive applicator of the invention provides the important advantage of obviating the need for manually administering adhesive to a floor substrate. The adhesive is applied under controlled conditions as a series of beads for effectively bonding carpet, tile or the like to a substrate.

It will be understood that modifications can be made in the embodiment of the invention described herein without departing from the scope and purview of the invention as defined by the appended claims.

I claim:

1. An apparatus for applying a water based adhesive having a viscosity in the range of about 11,000–13,500 centipoise to a substrate comprising:

a reservoir for holding the adhesive, said reservoir having a bottom wall defining a plane inclined to the horizontal defining a vertex, a pair of spaced apart parallel support rails extending upwardly from the plane of said bottom wall, a pair of side walls secured to the support rafts forming a base, a set of wheels depending from said base for portability, a pair of spaced apart cross members secured to said support rails, a pressure tank for receiving a gas under pressure removably attached to said cross members, a conduit for conducting a gas from the pressure tank to the reservoir, a pressure regulator in series with said conduit, said pressure regulator having control means for regulating the pressure of the gas supply to said reservoir, an applicator head for dispensing the adhesive to the substrate, said applicator head comprising means for rotatably mounting said applicator head on said reservoir in proximity to the base thereof whereby said applicator head can be rotated into an operative adhesive dispensing position or rotated through 180° into an inoperative position for preventing discharge of adhesive therefrom.

2. An apparatus for applying an adhesive to a substrate as claimed in claim 1 wherein said reservoir contains a pressure relief valve.

3. An apparatus for applying an adhesive to a substrate as claimed in claim 1 wherein said applicator head comprises a manifold and a dispenser joined together by a plurality of substantially equispaced interconnecting pipes.

4. An apparatus for applying an adhesive to a substrate as claimed in claim 3 wherein said dispenser contains a plurality of holes formed at substantially equally spaced intervals for dispensing the adhesive to the substrate.

* * * * *